US012410930B2

(12) United States Patent
Gerner et al.

(10) Patent No.: US 12,410,930 B2
(45) Date of Patent: Sep. 9, 2025

(54) ROOM UNIT FOR AN HVAC SYSTEM

(71) Applicant: BELIMO Holding AG, Hinwil (CH)

(72) Inventors: Pascal Gerner, Wetzikon (CH); Michael Bauernschmitt, Wetzikon (CH); Sebastian Eberle, Zürich (CH); Yoram Mottas, Fribourg (CH); Roman Kappeler, Uster (CH)

(73) Assignee: BELIMO Holding AG (CH)

( * ) Notice: Subject to any disclaimer, the term of this patent is extended or adjusted under 35 U.S.C. 154(b) by 144 days.

(21) Appl. No.: 18/286,251

(22) PCT Filed: Apr. 20, 2022

(86) PCT No.: PCT/EP2022/060448
§ 371 (c)(1),
(2) Date: Oct. 10, 2023

(87) PCT Pub. No.: WO2022/223638
PCT Pub. Date: Oct. 27, 2022

(65) Prior Publication Data

US 2024/0183557 A1 Jun. 6, 2024

(30) Foreign Application Priority Data

Apr. 22, 2021 (CH) ..... 432/21

(51) Int. Cl.
*F24F 11/50* (2018.01)
*F24F 11/89* (2018.01)
*F24F 110/10* (2018.01)

(52) U.S. Cl.
CPC ..... *F24F 11/50* (2018.01); *F24F 11/89* (2018.01); *F24F 2110/10* (2018.01)

(58) Field of Classification Search
CPC ..... F24F 11/50; F24F 11/52; F24F 11/89
See application file for complete search history.

(56) References Cited

U.S. PATENT DOCUMENTS

2016/0327301 A1* 11/2016 Ribbich ..... H05B 47/11
2020/0225653 A1* 7/2020 Lamont ..... G05D 7/0635

FOREIGN PATENT DOCUMENTS

CN 111692687 A 9/2020

OTHER PUBLICATIONS

CN 111692687 A Machine Language Translation into English.
(Continued)

*Primary Examiner* — Jonathan Bradford
(74) *Attorney, Agent, or Firm* — Lerner David LLP

(57) ABSTRACT

A room unit for an HVAC system is disclosed. The system includes a housing for installing the room unit on a wall of a building; a connection means to connect the device to the HVAC system; a controller being arranged on a first printed circuit board; and at least one temperature sensor to measure the temperature of ambient air, whereby the at least one temperature sensor is arranged on a frontside of a second printed circuit board. In addition, the second printed circuit board protrudes from the first printed circuit board, especially in a direction perpendicular to the first printed circuit board. Still further, the second printed circuit board is arranged such that a backside of the second printed circuit board is in physical contact with an inner surface of the housing.

17 Claims, 6 Drawing Sheets

(56) References Cited

OTHER PUBLICATIONS

PCT/EP2022/060448 International Search Report.
Swiss Patent Application No. 432/21 Search Report.
Swiss Patent Application No. 432/21 Search Report Machine Language Translation into English.

* cited by examiner

ROOM UNIT FOR AN HVAC SYSTEM

CROSS REFERENCE TO RELATED APPLICATIONS

This application is a national phase of International Application PCT/EP2022/060448, filed Apr. 20, 2022, which claims priority to Swiss patent application 432/21, filed Apr. 22, 2022, the content of both of which is hereby incorporated by reference.

BACKGROUND OF THE INVENTION

Field of the Invention

The invention relates to a room unit for an HVAC system comprising a housing for installing the room unit on a wall of a building, a connection means to connect the device to the HVAC system, a controller being arranged on a first printed circuit board and at least one temperature sensor to measure the temperature of ambient air whereby the at least one temperature sensor is arranged a second printed circuit board.

Description of Related Art

Heating, ventilation, and air conditioning (HVAC) systems are in use in many public buildings, such as schools, shops, etc., industrial buildings, in office buildings as well as in private homes. Such systems usually include a room unit, in particular a room control unit or a room sensor, in each controlled room, space or zone of the building, which allows to measure and/or set values, such as e.g. room temperature, ventilation intensity, by users. The room units usually comprise sensors, which measure certain air parameters in the room, space or zone, such as ambient temperature, relative humidity and/or the $CO_2$ content, in order to provide the parameters to a central control of the HVAC system. The room units may further comprise screens to display information about the set values and the measured parameters.

Typically, room units for HVAC systems are mounted to a wall of a building in the controlled room, space or zone.

However, an issue with room units comprising temperature sensors is that heat generated by microprocessors or other electronic components, which are part of the controller of the room unit, can affect temperature measurement such that the temperature measured may not accurately reflect the ambient room temperature. In order to reduce this undesired effect, temperature sensors frequently are thermally isolated from the other electronic components.

In this regard, U.S. Pat. No. 8,197,130 B2 (Siemens) describes for example a temperature sensing device with a housing comprising thermally isolating partition walls at the inside that are configured to thermally isolate the temperature sensor from the residual electronic components. Additionally the printed circuit board of the unit comprises a machined slot between the temperature sensor and the residual electronic components for reducing heat transfer through the printed circuit board.

However, thermal isolation of the temperature sensor might negatively affect response times of the temperature sensor upon temperatures changes in the controlled room, space or zone.

Thus, there is still a need to develop improved room units for HVAC systems which do not have the disadvantages mentioned above or have them to a lesser extent.

BRIEF SUMMARY OF THE INVENTION

It is an object of the invention to provide an improved room unit. Preferably, a room unit should be provided that is capable to reliably measure ambient air parameters, especially ambient temperature, in the controlled room, space or zone of a building.

A solution of the invention is specified by the features of claim 1. According to the invention, the room unit for an HVAC system comprises:

- a housing for installing the room unit on a wall of a building;
- a connection means to connect the device to the HVAC system;
- a controller being arranged on a first printed circuit board;
- at least one temperature sensor to measure the temperature of ambient air, whereby the at least one temperature sensor is arranged on a frontside of a second printed circuit board; wherein the second printed circuit board protrudes from the first printed circuit board, especially in a direction perpendicular to the first printed circuit board;
- whereby the second printed circuit board is arranged such that a backside of the second printed circuit board in physical contact with an inner surface of the housing.

The combination of the at least one temperature sensor arranged on a frontside of a second printed circuit board, which protrudes from the first printed circuit board and which is in physical contact via its backside with the inner surface of the housing turned out to be highly beneficial. With this setup the temperature sensor is thermally decoupled from the heat generating elements, e.g. microprocessors or other electronic components, which are part of the controller of the room unit. At the same time, the temperature of the housing of the room unit, which essentially corresponds to the temperature of the ambient air in the controlled room, space or zone is efficiently coupled to the second printed circuit board or the temperature sensor, respectively. This allows to obtain fast response times upon temperatures changes in the controlled room, space or zone.

Consequently, the inventive setup allows to accurately measure the ambient room temperature essentially independently of the heat evolution of the controller on the first printed circuit board.

Furthermore, the inventive arrangement is obtainable with established standard assembly methods for printed circuit boards. Put differently, there is no need for complex manufacturing processes or even manual labor. Hence, the inventive arrangement can be produced in a highly efficient and cost effective manner.

Especially, the second printed circuit board is fixed, especially soldered and/or plugged, on the first printed circuit board, in particular with at least one or more pin connectors. Preferably, there are at least two, three, or more pin connectors. Pin connectors preferably are electrical connectors. This allows for a compact and mechanically stable connection between the two circuit boards. However, other setups are possible as well.

According to a preferred embodiment, the backside of the second printed circuit board comprises a heat conductive coating, which is in contact with the inner surface of the housing. In this case, the heat conductive coating of the second printed circuit board acts as a thermal bridge between the second printed circuit board and the housing. This greatly enhances the thermal coupling between the housing and the second printed circuit board or the temperature sensor, respectively, which in turn improves response times upon temperatures changes in the controlled room, space or zone.

However, depending on the specific application, the coating can be omitted in order to simplify the setup.

Preferably, the heat conductive material is a material with a thermal conductivity (λ) of at least 10 W/(m·K), preferably at least 100 W/(m·K), in particular at least 200 W/(m·K), whereby the thermal conductivity is measured at 0 C, at a pressure of 1.013 bar and a humidity of 50%.

Especially, the heat conductive material is a metallic material, in particular comprising or consisting of copper, aluminum, silver and/or gold. These materials feature a relatively high thermal conductivity while being mechanically and chemically stable for use as a coating in the inventive room unit. Nevertheless, other materials can be suitable as well.

If present, the coating of the heat conductive material preferably covers at least 50%, especially at least 75%, in particular at least 90%, of the backside area of the second printed circuit board.

Preferably, a thickness of the coating of the heat conductive material is 0.001-1 mm, especially 0.01-0.5 mm, in particular 0.02-0.05 mm.

This results in a highly effective coupling between housing and second printed circuit board. However, the area share of the heat conductive coating can be below 50% and/or the thickness can be chosen differently, if desired for specific embodiments.

According to a further preferred embodiment, at least one humidity sensor to measure the humidity of ambient air is additionally arranged on the second printed circuit board. Also for these kind of sensors, reliable temperature conditions are important. Of course, the second printed circuit board might comprise further sensors.

In particular, a combined sensor for measuring temperature and humidity of ambient air is arranged on the second printed circuit board. This results in a space-saving structure and an easier readout of the sensors.

Especially, the at least one temperature sensor, the at least one humidity sensor and/or the combined sensor is an active sensor. In the present context, an active sensor is meant to be a sensor device that is powered with input energy from a source other than that which is being sensed for delivering an output signal. In contrast, a passive sensor works without input energy. If desired, the invention can be implemented with passive sensors as well.

In a further preferred embodiment, a further sensor for measuring a further parameter of ambient air is arranged on the first printed circuit board, especially the further sensor is a sensor for measuring a concentration of $CO_2$, volatile organic compounds (VOC) and/or particulate matter. These kind of sensors, typically produce a considerable amount of heat during operation. Therefore, it is beneficial to arrange them on the first printed circuit board, i.e. thermally decoupled from the second printed circuit board comprising the temperature sensor.

However, a further sensor for measuring a further parameter of ambient air arranged on the first printed circuit board sensors is optional.

Preferably, the second printed circuit board is located at an edge of the first printed circuit board. This allows for a direct contacting of the second printed circuit board and the inner surface of the housing by placing the first printed circuit board nearby the inner surface and the second printed circuit board can be separated as far as possible from the heat generating components on the first printed circuit board. However, other setups are possible as well. For example, the second printed circuit board can be located on a more central section of the first printed circuit board. In this case, the housing might feature an inner bulge for contacting the second printed circuit board.

Preferably, with respect to an installed state of the room unit,

- the controller is spaced in horizontal direction from the second printed circuit board, whereby, preferably, in horizontal direction the controller is located in the other half of the first printed circuit board than the second printed circuit board; and/or
- the controller is spaced in vertical direction from the second printed circuit board, whereby, preferably, the controller is located above the second printed circuit board; and/or
- the second printed circuit board is located in a lower half of the first printed circuit board; and/or
- if present, the further sensor for measuring a further parameter of ambient air, with respect to an installed state of the room unit, is arranged in a section of the first printed circuit board in vertical direction above the second printed circuit board.

With these measures, the second printed circuit board can optimally be separated from heat generating components on the first printed circuit board. Thereby, if the second printed circuit board is located in vertical direction below the heat generating components, ascending heat produced by these components will not flow around the second printed circuit board. Nevertheless, other setups are possible as well.

Especially, in a first section of the first printed circuit board, in which the second printed circuit board is installed,

- there is no metallic ground plane on or within the first printed circuit board; and/or
- a surface area of metallic connection lines and/or metallic ground planes on or within the first printed circuit board is below 50%, especially below 25%, in particular below 10%, with respect to the total surface area of the first section; and/or
- the first section is separated from a second section of the first printed circuit board, in which the controller is located, by at least one slit-shaped opening in the first printed circuit board, especially for thermally decoupling the two sections.

In a further preferred embodiment, the first printed circuit board comprises a third section in which the at least one further sensor is located, whereby, the third section is separated from the first and/or the second section by at least one further slit-shaped opening in the first printed circuit board, especially for thermally decoupling the third section from the first and/or the second section.

In the embodiments described above, the first section preferably has a surface share of 5-50%, especially 7-30%, in particular 10-20%, with respect to the total surface area of the first printed circuit board.

These measures, each one alone and even more in combination with each other, help to further thermally decouple the second printed circuit board from the first printed circuit board.

Preferably, the housing of the room unit comprises: a mounting plate for installing the room unit on a wall of a building; a housing frame which is attachable or attached to the mounting plate, whereby the housing frame comprises a circumferential side wall which laterally surrounds the inside of the room unit; and a front housing part, which is configured for closing the housing frame at its free end opposite the mounting plate.

In this case, the mounting plate, the housing frame and the front housing part preferably all are separate parts to have maximum flexibility. However, the housing frame and the front housing part can be provided in the form of one component, if desired.

In particular, in the present context, the housing frame may also be referred to as mounting frame.

Preferably, in installed state, the heat conductive coating is in physical contact with an inner surface of the side-wall of the housing frame, in particular in horizontal direction at a lateral side of the inner surface, especially at a side of the support structure facing away from the mounting plate.

Such a setup is beneficial for installation and maintenance of the room unit. For example, when installing the room unit, the mounting plate is freely accessible what simplifies the mounting to the wall and electrical cables of the HVAC system can be passed through cable inlets and/or attached to electrical connectors on the mounting plate more easily.

Preferably, the housing, especially the housing frame, comprises a support structure, in particular a tray, for carrying the first printed circuit board within the inside of the housing, in particular within an inner volume surrounded by the side-wall of the housing frame, especially on a side of the support structure facing away from the wall and/or the mounting plate.

The support structure preferably defines a fixed position of the circuit boards in the housing. If the support structure is present in the above mentioned housing frame, the first printed circuit board with the second printed circuit board can be installed beforehand on the support structure and later on attached to the mounting plate. This greatly simplifies installation and maintenance.

The support structure preferably covers 50-100%, especially 70-90%, of the cross-sectional area of the inner volume surrounded by the side-wall of the housing frame. This allows for dividing the housing into two distinct volumes, such that, for example, the circuit boards can be protected against undesired forces during installation.

Especially, the first printed circuit board comprises one or more pin connectors for connecting the controller to the connection means.

In this case, preferably, the mounting plate comprises the connection means to connect the device to the HVAC system, especially a connector for a bus system, especially a field bus system, and/or a socket which is configured for receiving the one or more pin connectors of the first printed circuit board.

Most preferably, the pin connectors of the first printed circuit board and the connection means are configured such that the one or more pin connectors can be inserted or are inserted into the socket, especially through openings in the support structure, especially in a direction perpendicular to the mounting plate.

This allows for an easy and safe installation since the first printed circuit board can simply be pressed on the connection means for establishing a connection. This is in particular beneficial in combination with the housing as described above comprising at least two or three separate components.

In a highly preferred embodiment, the housing, especially the front housing part, comprises a display, preferably an electronic paper display, especially covered with a transparent cover. This allows to display information about the set values and the measured parameters.

In particular, the display is a touch-screen or is overlaid by a touch sensitive foil. Such a display can be used as an input device to set values, such as e.g. a desired room temperature, ventilation intensity, etc., by users.

However, in another preferred embodiment, the housing, especially the front housing part, comprises or consists of a blind cover. In this case, no display is present and the room unit is intended to function without user input or user input is provided via other input devices, e.g. wireless communication modules, switches, and/or buttons.

Furthermore, the room unit preferably comprises a short-range wireless communication module which allows wireless communication with a mobile device for the exchange of data between the mobile device and the room unit, and vice versa.

Further preferred, the room unit comprises an antenna for wireless communication, especially, an antenna of the above mentioned short-range wireless communication module.

Especially, the controller comprises a microcontroller or microprocessor as well as at least one memory. In installed state, the controller is in particular electrically connected to the connection means, especially via the pin connectors, and to the second printed circuit board or the at least one temperature sensor, respectively. If present, the controller is furthermore connected to the display and/or the at least one further sensors.

In particular, the controller is configured to send data to and receive data from the HVAC system. Furthermore, the controller can be configured for presenting data on the display, if present, and/or reading data from an input device, if present. The data comprises for example temperature data, humidity data, $CO_2$ data, data on particulate matter and/or ventilation data.

Other advantageous embodiments and combinations of features come out from the detailed description below and the entirety of the claims.

BRIEF DESCRIPTION OF THE SEVERAL VIEWS OF THE DRAWINGS

Further advantages features and details of the various embodiments of this disclosure will become apparent from the ensuing description of a preferred exemplary embodiment or embodiments and further with the aid of the drawings. The features and combinations of features recited below in the description, as well as the features and feature combination shown after that in the drawing description or in the drawings alone, may be used not only in the particular combination recited but also in other combinations on their own without departing from the scope of the disclosure. The following is an advantageous embodiment of the invention with reference to the accompanying figures, wherein.

In the figures, the same components are given the same reference symbols.

DETAILED DESCRIPTION OF THE INVENTION

Figure 1:
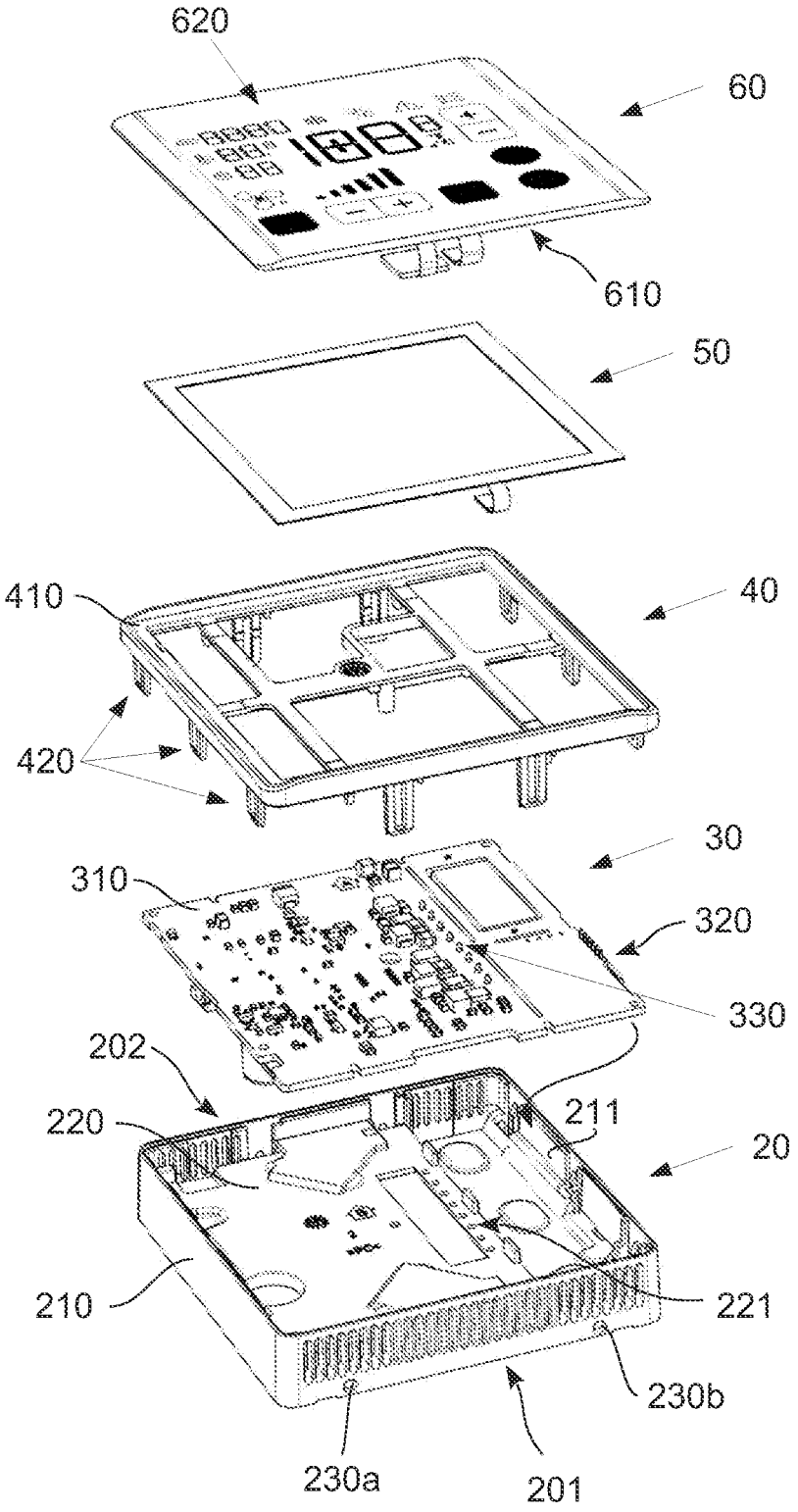
FIG. 1 depicts an exploded perspective view of a housing frame, a printed circuit board, a frame element, a planar frame-shaped antenna for wireless communication and an electronic paper display with touch functionality, for use in a room unit.

The subject-matter described in the following will be clarified by means of a description of those aspects which are depicted in the drawings. It is however to be understood that the scope of protection of the invention is not limited to those aspects described in the following and depicted in the drawings; to the contrary, the scope of protection of the invention is defined by the claims. Moreover, it is to be understood that the specific conditions or parameters described and/or shown in the following are not limiting of the scope of protection of the invention, and that the terminology used herein is for the purpose of describing particular aspects by way of example only and is not intended to be limiting.

Unless otherwise defined, technical and scientific terms used herein have the same meaning as commonly understood by one of ordinary skill in the art to which this invention belongs. Further, unless otherwise required by the context, singular terms shall include pluralities and plural terms shall include the singular. The methods and techniques of the present disclosure are generally performed according to conventional methods well known in the art and as described in various general and more specific references that are cited and discussed throughout the present specification unless otherwise indicated. Further, for the sake of clarity, the use of the term "about" is herein intended to encompass a variation of +/−10% of a given value.

Non-limiting aspects of the subject-matter of the present disclosure will be described by way of example with reference to the accompanying figures, which are schematic and are not intended to be drawn to scale. For purposes of clarity, not every component is labelled in every figure, nor is every component of each aspect of the invention shown where illustration is not necessary to allow those of ordinary skill in the art to understand the invention.

The following description will be better understood by means of the following definitions.

As used in the following and in the appended claims, the singular forms "a", "an" and "the" include plural referents unless the context clearly dictates otherwise. Also, the use of "or" means "and/or" unless stated otherwise. Similarly, "comprise", "comprises", "comprising", "include", "includes" and "including" are interchangeable and not intended to be limiting. It is to be further understood that where for the description of various embodiments use is made of the term "comprising", those skilled in the art will understand that in some specific instances, an embodiment can be alternatively described using language "consisting essentially of" or "consisting of."

Figure 12:
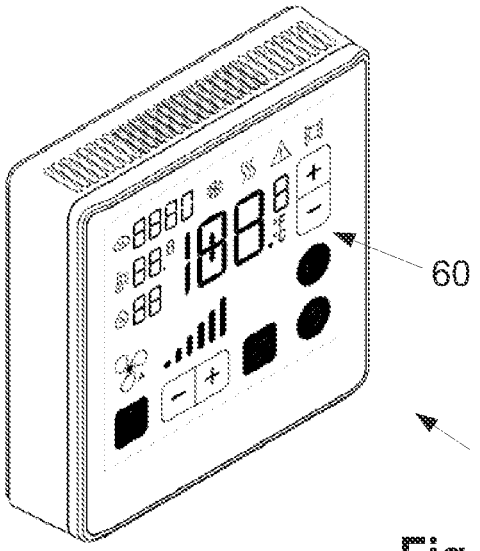
FIG. 12 depicts a perspective view of a room unit comprising the components as shown in FIG. 1-11 in assembled state.

FIG. 1 shows an exploded view of a housing frame 20, a printed circuit board 30, a frame element 40, a planar frame-shaped microstrip antenna 50 for wireless communication and an electronic paper display 60 with touch functionality, which are components of a first room unit 1 as shown in FIG. 12.

The housing frame 20 comprises a circumferential side wall 210 enclosing an inner volume of the housing frame 20. The side wall 210 comprises two bores 230*a*, 230*b* next to slit-shaped air vents at a bottom side 201 (in vertical direction with respect to the installed state) for fixing the housing frame 20 on a mounting plate 10 (see FIG. 2-4). The upper side 202 (in vertical with respect to the installed state) opposing the bottom side 201 comprises further slit-shaped air vents.

The inner volume of the housing frame 20 is divided into a lower part and an upper part with a tray-like support structure 220 with several breakthroughs for receiving the printed circuit board 30.

The printed circuit board 30 comprises a first printed circuit board 310 and a second printed circuit board 320 protruding from an edge of the first printed circuit board 310 in a direction perpendicular to the first printed circuit board 310. In a central part, there are 8 pin connectors 330 protruding in a direction towards the housing frame 20 (in FIG. 1 only the backside ends of the pin connectors are visible). Further details of the printed circuit board 30 and the arrangement in the housing frame 20 are given in FIG. 8-11.

As section of the inner surface 211 of the side wall 210 of the housing frame 20 is configured for contacting the second printed circuit board 320 in assembled state. In a central part of the support structure 220 there are 8 circular openings 221 for passing through the pin connectors 330 of the printed circuit board. Other breakthroughs present for accommodating bulky electronic components of the printed circuit board 30.

The frame element 40 comprises a circumferential edge 410 as well as several supporting ribs and is configured for receiving the planar frame-shaped microstrip antenna 50 and the touch-screen display 60. In assembled state, the antenna 50 is located at the backside 610 of the display 60 in physical contact with it. The outer dimensions of the antenna 50 are essentially identical to the out dimensions of the display 60. The stack consisting of the antenna 50 and the display 60 can be materially bonded to the frame 40. The frame 40 then can be attached to the housing frame 20 with ten snap-in connectors 420 that can engage with corresponding counterparts at the inner surface 211 of the side wall 210.

Frame element 40 and display 60 together form a front housing part.

Figure 2:
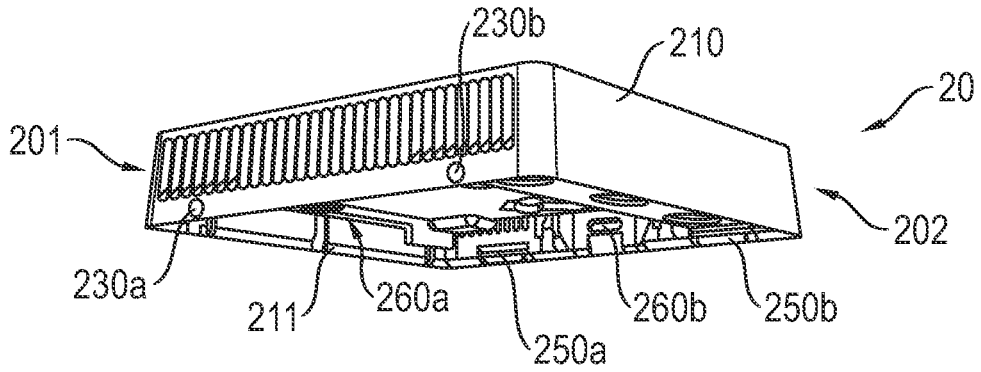
FIG. 2 A depicts a perspective view of the part of the housing frame of FIG. 1.

FIG. 2 shows a view of housing frame 20 opposite the printed circuit board 30. At the inside of the upper side 202, the side wall 210 comprises two wedge-shaped protrusions, 250*a*, 250*b* projecting away from the inner surface of the side wall 210 towards an opposite inner surface of the housing frame 20.

Furthermore, there is a connection element 260*b* in the form of a recess between the two protrusions 250*a*, 250*b*, which is part of a mechanical snap-in connector for fixing the housing frame 20 to the mounting plate 10. At the side opposite of the protrusions 250*a*, 250*b*, there is a further connection element 260*a*, which is identical in design.

Figure 3:
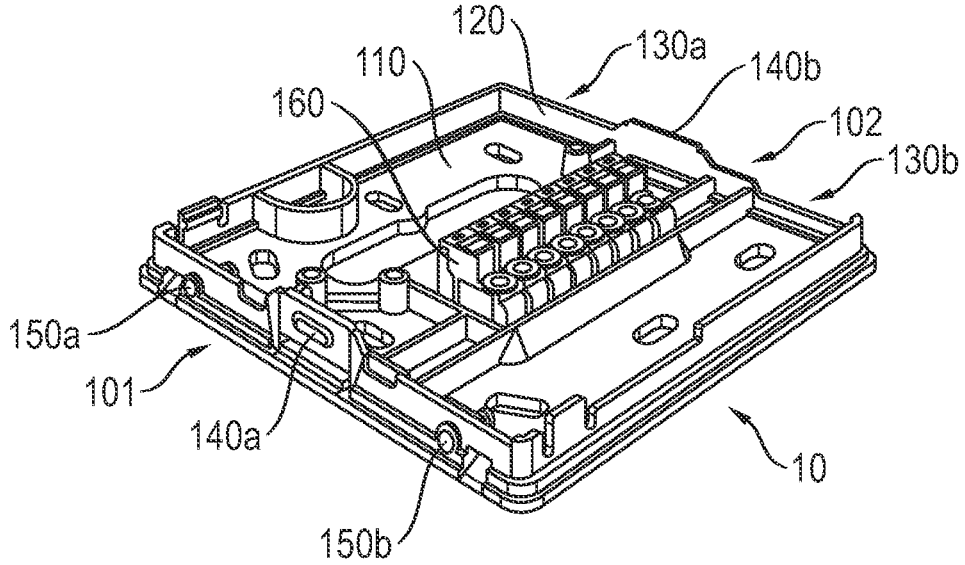
FIG. 3 A depicts a mounting plate comprising a base plate with a circumferential rim projecting away perpendicularly from the base plate for use in room unit together with the components of FIG. 1.

FIG. 3 shows a mounting plate 10 comprising a square base plate 110 with a circumferential rim 120 projecting away perpendicularly from the base plate 110, whereby the rim is offset inwards from a circumferential edge of the base plate 110 by approximately a thickness of the side wall 210 of the mounting frame 20. The side wall 210 is configured for receiving the rim 120 of the mounting plate 10 with positive fit.

At the bottom side 101 (in vertical with respect to the installed state) of the rim 120, there are two headless screws 150*a*, 150*b* arranged in a nut behind the rim 120, whereby in a first position as shown in FIG. 3, the screws 150*a*, 150*b* are fully located below an outer surface of the rim 120 of the mounting 10 plate. If the rim 120 of the mounting plate 10 is received in the housing frame 20 and the screws 150*a*, 150*b* are brought in a second position, in which the screws 150*a*, 150*b* protrude outside the outer surface of the rim 120 into the corresponding bores 230*a*, 230*b*, the housing frame 20 is additionally secured to the mounting plate 10 in assembled state.

Additionally, in a central part of the bottom side 101 of the rim 120 there is a connection element 140*a* in the form of a bulge, which is configured to engage with the connection element 260*a* of the housing frame 20. Thereby, connection elements 140*a*, 260*a* form a snap-in connector.

At the central part of the upper side 102 (in vertical direction with regard to the installed state) of the rim 120 there is a further connector element 140*b*, which is identical in design and configured to engage with the connection element 260*b* of the housing frame 20, thus forming another snap-in connector.

The sections of the side wall 210 comprising the connector elements 260*a*, 260*b* are configure as break-out section.

At the upper side 102 of the rim, which is opposed to the bottom side 101, there are two spaced wedge-shaped protrusions 130*a*, 130*b* (not visible in FIG. 3; cf. FIG. 4) projecting away from an outer surface of the rim 120 in a direction parallel to the base plate 110.

Within the context of the present invention, protrusions 130*a*, 130*b* are called first protrusions and protrusions, 250*a*, 250*b* are called second protrusions.

Figure 5:
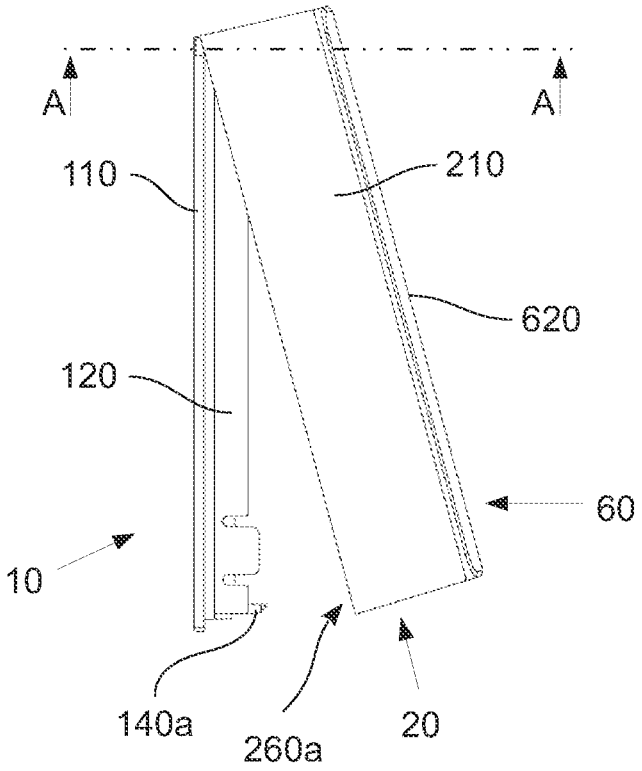
FIG. 5 depicts an intermediate state during the connection of the housing frame of FIG. 1 and the mounting plate of FIG. 3.
Figure 6:
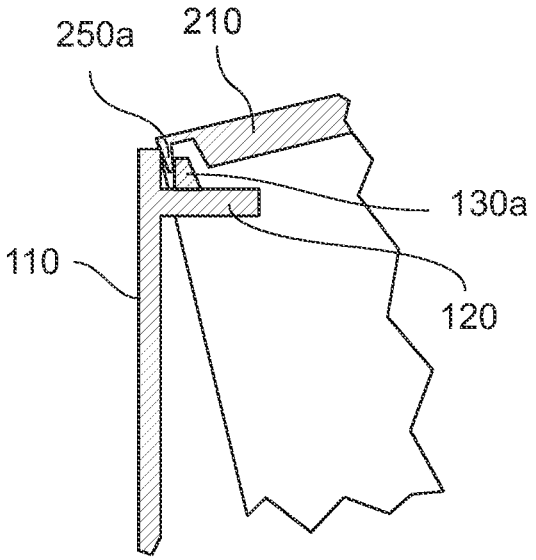
FIG. 6 A depicts a detailed view of the interlocking between the housing frame and the mounting plate in the intermediate state shown in FIG. 5.
Figure 7:
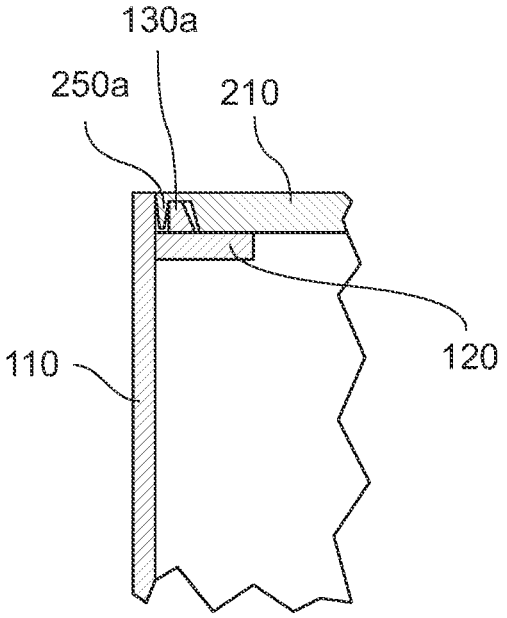
FIG. 7 A depicts a detailed view of the interlocking between the housing frame and the mounting plate after pivoting the housing frame into the closes state.

The first protrusions 130*a*, 130*b* of the base plate and the respective second protrusions 250*a*, 250*b* of the housing frame 20 are configured in such a way that they can interlock with each other with a positive fit when the rim 110 of the mounting plate 10 is at least partly received in the circumferential side wall 210 of the mounting frame 20 (see FIG. 5-7 for more details).

The sections of the rim 120 comprising the connector elements 140*a*, 140*b* are configured as break-out sections each with two predetermined breaking points.

Additionally, there is a socket 160 which is configured for receiving pin connectors 330 of the printed circuit board 30. They can be inserted into the socket 160 through the circular openings 221 in the support structure 220 in a direction perpendicular to the mounting plate 10.

Figure 4:
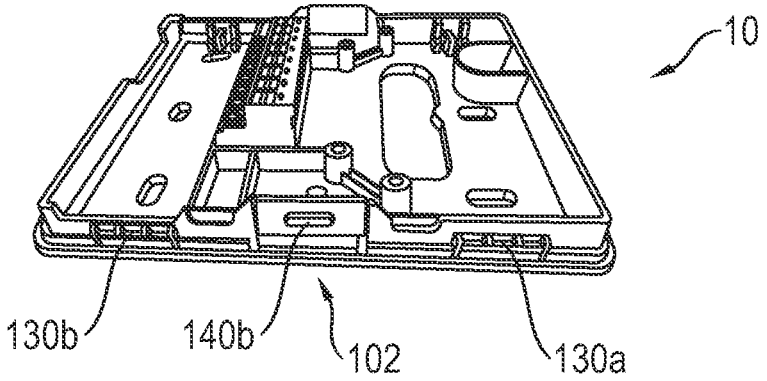
FIG. 4 A depicts a top view onto the upper surface of the mounting plate of FIG. 3 with two first protrusions protruding away from the outer surface of the rim.

FIG. 4 shows a top view onto the upper surface 102 of the mounting plate 10, showing the first protrusions 130*a*, 130*b* protruding away from an outer surface of the rim 120 in a direction parallel to the base plate 110, i.e. in FIG. 4 into the direction of the viewer.

FIG. 5 shows an intermediate state during the connection process of the housing frame 20 and the mounting plate 10. Thereby, the components 30, 40, 50 and 60 have been attached to the housing frame 20 and the mounting plate has been fixed on a wall of a building (not shown) beforehand. Specifically, the housing frame 20 is hooked with its protrusions 250*a*, 250*b* onto the protrusions 130*a*, 130*b* protruding in vertical direction from the upper side of the rim 120 of the mounting plate 10. Thereby, the housing frame stands off at an angle with respect to the base plate 110 at an angle of for example 25.

FIG. 6 shows a detailed view of the interlocking between the first protrusion 130*a* and the second protrusion 130*b* in a cross-section of the upper left corner along line A-A of FIG. 5.

Thereafter, the housing frame 20 is pivoted around the interlocked protrusions 130*a*, 130*b*, 250*a*, 250*b* until the connection elements 140*a*, 260*a*, i.e. the snap-in connector, engage and, together with the interlocked connection elements 140*a*, 260*a*, secure the housing frame 20 to the mounting plate 10. The corresponding detailed view of this situation is shown in FIG. 7. Thereafter, the housing frame can be further secured with the screws 150*a*, 150*b* by bringing them in engagement with the bores 230*a*, 230*b*. In FIG. 12 a perspective view of the resulting room unit 1 in assembled state is shown.

In order to enable the pivoting motion, tolerances for the positive fit between the side wall 210 and the rim 120 of the mounting plate 10 are chosen accordingly. Furthermore the tolerances allow for pressing the housing frame in a direction perpendicular to the mounting plate 10, such that the protrusions 130*a*, 130*b*, 250*a*, 250*b* and the connection elements 140*a*, 260*a* can slip-over without prior hooking.

Figure 8:
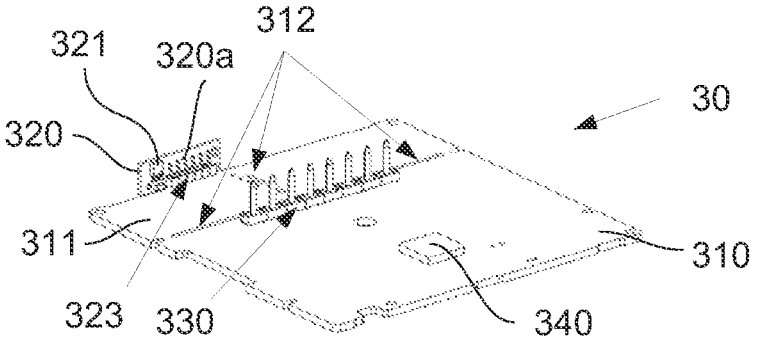
FIG. 8 depicts the printed circuit board comprising a first printed circuit board and a second printed circuit board protruding from an edge of the first printed circuit board in a direction perpendicular to the first printed circuit board.
Figure 9:
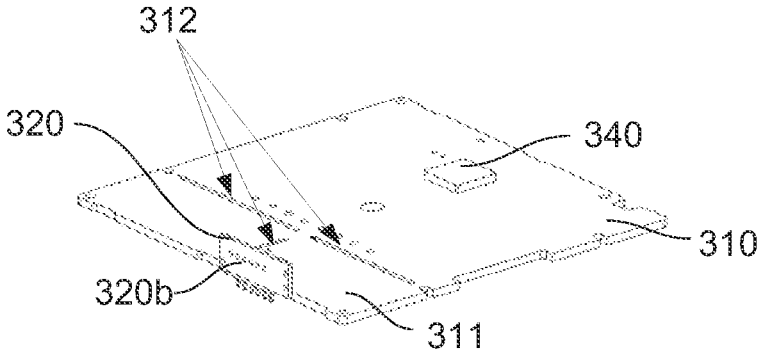
FIG. 9 depicts another view of the printed circuit board of FIG. 8.

FIGS. 8 and 9 show the printed circuit board 30 from different perspectives. As already mentioned, the printed circuit board 30 comprises the first printed circuit board 310 and the second printed circuit board 320 protruding from an edge of the first printed circuit board 310 in a direction perpendicular to the first printed circuit board 310. The second printed circuit board 320 is for example soldered to the first printed circuit board with pin connectors.

On the first printed circuit board 310, a controller 340 comprising a microprocessor and a memory is arranged, whereas on the front side 320*a* of the second printed circuit board 320, a combined sensor 321 for measuring temperature and humidity of ambient air is arranged.

In a central part, there are 8 pin connectors 330 protruding in a direction perpendicular to the first printed circuit board 310.

A first section 311 of the first printed circuit board 310, in which the second printed circuit board is installed, is separated from the section comprising the controller 340 by slit-shaped openings 312 for thermally decoupling the two sections.

The backside 320*b* of the second printed circuit board 320 is coated with a copper coating having a thickness of for example 35 m essentially on the entire surface area.

Figure 10:
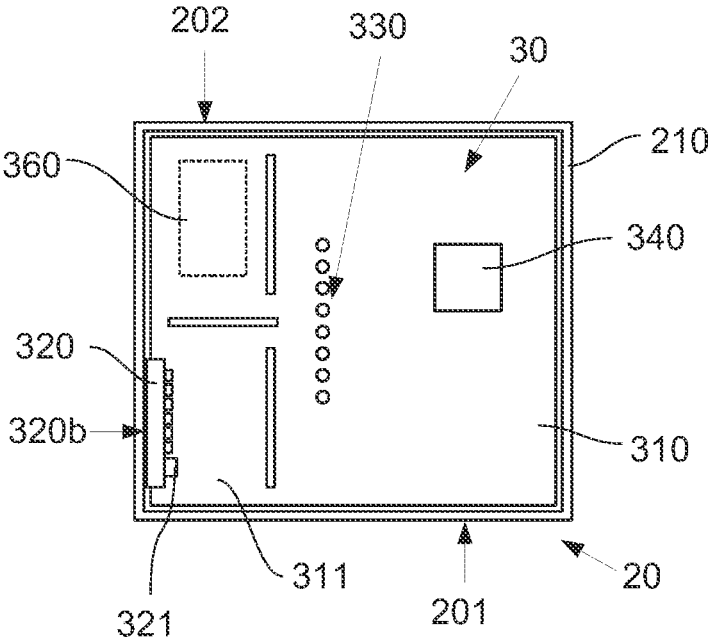
FIG. 10 depicts a top view on the printed circuit board of FIGS. 8 and 9 installed in the housing frame of FIG. 1 from the side opposite the mounting plate (without frame element, antenna and display attached)

FIG. 10 shows a top view on the printed circuit board 30 installed in the housing frame 20 from the side opposite the mounting plate (without frame element 40, antenna 50 and display 60 attached). In the lower left corner in FIG. 10, the backside 320*b* of the second printed circuit board 320 is in physical contact with the inner surface of the side wall 210 of the housing frame 20 in order to achieve a thermal coupling. If desired, a further sensor 360, e.g. a $CO_2$ sensor can be arrange in section 311, which preferably is isolated from the second printed circuit 320 and the controller by slit-shaped opening.

If the room unit is installed as intended with the bottom surface 201 of the housing pointing towards the floor and the upper surface 202 pointing towards the ceiling of the building, any ascending heat produced by the controller and the optional further sensor will not flow around the second printed circuit board.

Figure 11:
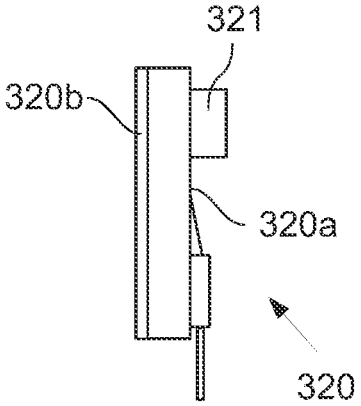
FIG. 11 depicts a detailed view of the second printed circuit board from a face side.

FIG. 11 shows a detailed view of the second printed circuit board 320 from a face side.

FIG. 12 shows a perspective view of the room unit 1 comprising the components as shown in FIG. 1-11 in assembled state.

Figure 13:
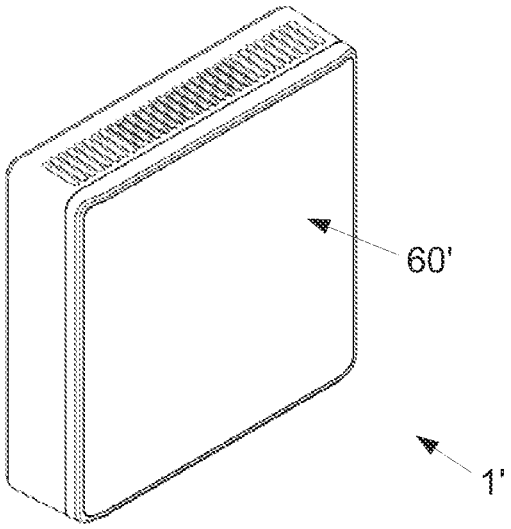
FIG. 13 depicts a further room unit comprises a blind cover as front housing part instead of a display.

FIG. 13 shows a further room unit 1', which is essentially identical in design with room unit 1. However, instead a display 60, the room unit 1' comprises a blind cover 60'.

Figure 14:
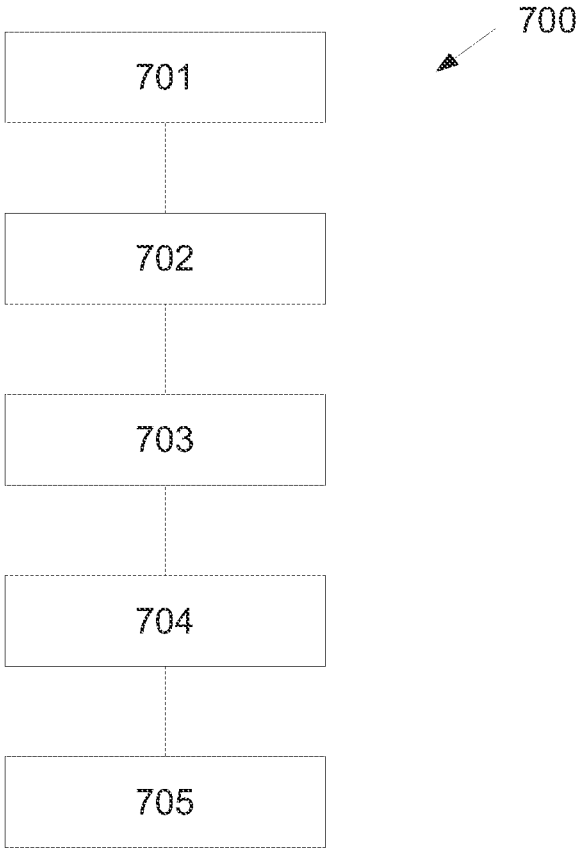
FIG. 14 depicts a schematic representation of a method for installing the room units of FIGS. 12 and 13 on a wall of a building.

FIG. 14 shows a method 700 for installing the room unit of FIG. 12 or 13, whereby in a first step 701, the front housing part, i.e. the frame element 40, the antenna 50 and display 60 or the blind cover 60', is attached to the housing frame 20 and thereby the housing frame 20 is closed at the free end.

In a second step 702, the mounting plate 10 is fixed on a wall of a building, whereby the mounting plate is arranged such the first protrusions 130*a*, 130*b* of the mounting plate 10 are located on an upper outer surface of the rim 120.

In a third step 703, the housing frame 20 is attached at the upper side 102 of the mounting plate 10, such that the second protrusions 250*a*, 250*b* of the housing frame 20 interlock with the first protrusions 130*a*, 130*b* in a positive manner and the housing frame 20 stands off the mounting plate 10 at an angle in FIG. 5.

Subsequently, in a fourth step 704, the housing frame 20 is pivoted around the interlocked protrusions 130*a*, 130*b*, 250*a*, 250*b* in order to entirely receive the rim 120 of the mounting plate 10.

In a fifth step 705, the housing frame 20 is secured to the mounting plate 10 with the connection elements 140*a*, 260*a*. Thereafter, the housing frame can be further secured with the screws 150*a*, 150*b* by bringing them in engagement with the bores 230*a*, 230*b*.

Of course, installation furthermore includes connecting electrical cables from the HVAC system to the socket 160.

Thus, it will be appreciated by those skilled in the art that the present invention can be embodied in other specific forms without departing from the spirit or essential characteristics thereof. The presently disclosed embodiments are therefore considered in all respects to be illustrative and not restricted.

In summary, it is to be noted that the invention provides highly beneficial room units which, despite the compact size, are capable to reliably measure ambient air ambient temperature in the controlled room, space or zone.

The scope of protection of the present invention is given by the claims and is not limited by the features illustrated in the description or shown in the figures.

The invention claimed is:

1. A room unit for an HVAC system comprising:

a) a housing configured to be installed on a wall of a building;

b) a connection means configured to connect the room unit to the HVAC system;

c) a controller arranged on a first printed circuit board; and d) at least one temperature sensor configured to measure a temperature of ambient air, wherein the at least one temperature sensor is arranged on a first side of a second printed circuit board;

wherein the second printed circuit board is arranged to protrude from the first printed circuit board in a direction perpendicular to the first printed circuit board; and wherein the second printed circuit board is arranged such that a second side of the second printed circuit board is in physical contact with an inner surface of the housing.

2. The room unit according to claim 1, wherein the second printed circuit board is fixed via solder and plug on the first printed circuit board with at least one or more pin connectors.

3. The room unit according to claim 1, wherein the second side of the second printed circuit board comprises a heat conductive coating arranged in contact with the inner surface of the housing.

4. The room unit according to claim 3, wherein the heat conductive material has a thermal conductivity of one of at least 10 W/(m-K), at least 100 W/(m-K), and at least 200 W/(m-K), wherein the thermal conductivity is measured at 0 degrees C., at a pressure of 1.013 bar and a humidity of 50%.

5. The room unit according to claim 4, wherein the heat conductive material is a metallic material comprising copper, aluminum, silver and/or gold.

6. The room unit according to claim 1, further comprising a coating of heat conductive material covering at least 50%, at least 75%, or at least 90%; of the area of the second side of the second printed circuit board.

7. The room unit according to claim 1, further comprising at least one humidity sensor configured to measure humidity of ambient air and arranged on the second printed circuit board.

8. The room unit according to claim 1, further comprising a further sensor configured to measure a further parameter of ambient air and arranged on the first printed circuit board, wherein the further parameter comprises a concentration of $CO_2$, volatile organic compounds (VOC) and/or particulate matter.

9. The room unit according to claim 1, wherein the second printed circuit board is arranged at an edge of the first printed circuit board.

10. The room unit according to claim 1, wherein the second printed circuit board is arranged in a lower half of the first printed circuit board when the room unit is in an installed state.

11. The room unit according to claim 10, wherein the controller is arranged in an other half in a horizontal direction from the second printed circuit board when the room unit is in the installed state.

12. The room unit according to claim 1, wherein, in a first section of the first printed circuit board wherein the second printed circuit board is installed, there is no metallic ground plane on or within the first printed circuit board; and/or the first section is separated from a second section of the first printed circuit board, in which the controller is located, by at least one slit-shaped opening in the first printed circuit board; and wherein, the first section comprises a surface share of 5-50%, 7-30%, or 10-20% with respect to the total surface area of the first printed circuit board.

13. The room unit according to claim 1, wherein the housing further comprises:

a mounting plate configured to install the room unit on said wall of the building; and a housing frame configured to be attachable or attached to the mounting plate;

wherein the housing frame comprises a circumferential side wall which laterally surrounds the inside of the room unit and a housing part configured to close the housing frame at a free end opposite the mounting plate.

14. The room unit according to claim 13, wherein the housing or the housing frame comprises a support structure, or a tray configured to carry the first printed circuit board within the inside of the housing or, within an inner volume surrounded by a side-wall of the housing frame, or on a side of the support structure facing away from the wall and/or the mounting plate.

15. The room unit according to claim 14, wherein, in an installed state, the heat conductive coating is in physical contact with an inner surface of the side-wall of the housing frame, in a horizontal direction at a lateral side of the inner surface, and at a side of the support structure facing away from the mounting plate.

16. The room unit according to claim 13, wherein the first printed circuit board comprises one or more pin connectors configured to connect the controller to the connection means and wherein the mounting plate further comprises the connection means configured and arranged to connect the device to at least one of the HVAC system, a connector for a bus system, a field bus system, and a socket which is configured for receiving the one or more pin connectors of the first printed circuit board.

17. The room unit according to claim 13, wherein the housing or the housing part comprises a display or an electronic paper display covered with a transparent cover, wherein the display is a touch-screen or is overlaid by a touch sensitive foil.

* * * * *